US006425216B1

(12) United States Patent
Gardner

(10) Patent No.: US 6,425,216 B1
(45) Date of Patent: Jul. 30, 2002

(54) #35 OUTSIDE MOUNT GLASS DOOR MOUNT

(75) Inventor: Larry S. Gardner, Hoover, AL (US)

(73) Assignee: Alabama Venetian Blind Company, Birmingham, AL (US)

( * ) Notice: Subject to any disclaimer, the term of this patent is extended or adjusted under 35 U.S.C. 154(b) by 0 days.

(21) Appl. No.: 09/813,482

(22) Filed: Mar. 20, 2001

(51) Int. Cl.[7] ..... E06B 3/30

(52) U.S. Cl. ..... 52/204.53; 52/202; 52/656.5; 52/717.01

(58) Field of Search ..... 52/202, 203, 204.1, 52/204.2, 762, 764, 656.2, 656.4, 656.5, 716.1, 717.01, 717.05, 730.6, 731.7, 206, 204.53, 204.59; 49/61–64, 67, 74.1; 160/104

(56) References Cited

U.S. PATENT DOCUMENTS 3,984,955 A * 10/1976 Yamamoto et al. ..... 52/202
4,326,360 A * 4/1982 Davidson ..... 49/63
4,505,079 A * 3/1985 Black ..... 52/202
5,620,037 A * 4/1997 Apostolo ..... 160/118
5,894,706 A 4/1999 Herbst
6,213,187 B1 * 4/2001 Hughes ..... 160/90

* cited by examiner

*Primary Examiner*—Carl D. Friedman
*Assistant Examiner*—Naoko Slack
(74) *Attorney, Agent, or Firm*—Brendan E. Squire; Robert J. Veal; Burr & Forman LLP

(57) ABSTRACT

This invention relates to the field of extruded polyvinyl foam shutters. More particularly this invention relates to a frame for mounting shutters on doors with glass panels. The present invention addresses the problem in the industry by providing a shutter mounting frame which has an extension normal to the mounting surface which conceals the glass mounting bead, and positions the framing piece so that the mounting nails or screws are inserted through the shutter frame into the glass mounting bead.

29 Claims, 4 Drawing Sheets

#35 OUTSIDE MOUNT GLASS DOOR MOUNT

TECHNICAL FIELD

This invention relates to the field of extruded polyvinyl foam shutters. More particularly this invention relates to a frame for mounting shutters on doors with glass panels.

BACKGROUND OF THE INVENTION

Traditionally, shutters have been made from wood; however, wooden shutters tend to wear out. Wood expands and contracts with the weather resulting in visible signs of wear and tear. As a result of this wear and tear, the dimensions of wooden shutters can change during storage, shipment, or use depending on the environmental conditions.

More recently shutters have been made of extruded polyvinyl materials which have excellent structural rigidity and which do not expand, contract, warp, or absorb liquids. Extruded polyvinyl is a good insulator, nonflammable, and resistant to wear and tear. Polyvinyl can be extruded into a variety of shapes in a process which generates little waste. Because of these properties, the measurements of polyvinyl foam shutters remain constant despite environmental conditions during storage, shipment, or use of the shutters.

A wide variety of shutter assemblies are currently available on the market, but there are some customer desires that the current market has been unable to meet. One such example is customers' desire for shutters that will mount on doors which have glass inserts. Glass inserts are secured in the door by a mounting bead which is made of a flexible pliant material forming a seal around the glass. This glass mounting bead is slightly raised from the surface of the door, making it awkward to mount a standard shutter frame on the door. Shutters are available which will mount on a door; however, there is not an existing frame that effectively conceals the glass mounting bead while securely mounting the shutter frame to the door.

BRIEF SUMMARY OF THE INVENTION

The present invention addresses the problem in the industry by providing a shutter mounting frame which has an extension normal to the mounting surface which conceals the glass mounting bead, and positions the framing piece so that the mounting nails or screws are inserted through the shutter frame into the glass mounting bead.

In its preferred embodiment, the outside mount glass door mount is an elongated, generally T shaped member made of extruded polyvinyl foam. The frame is extruded in three integrally connected sections. The first section is essentially L shaped and includes the rear mounting surface which will be mounted to the door, the shutter mounting surface to which the shutter panels will be attached, and the visible molded surface. The second section is integrally connected to the first section, essentially rectangular, and extends, normal to the rear mounting surface proximate to the visible molded surface, to cover the glass mounting bead on the door. The third section is integrally connected to the first section, essentially rectangular, and extends from the first section, normal and proximate to the shutter mounting surface, to stop light from passing between the hingedly attached first section and the shutter panel.

DETAILED DESCRIPTION OF THE INVENTION

Figure 1:
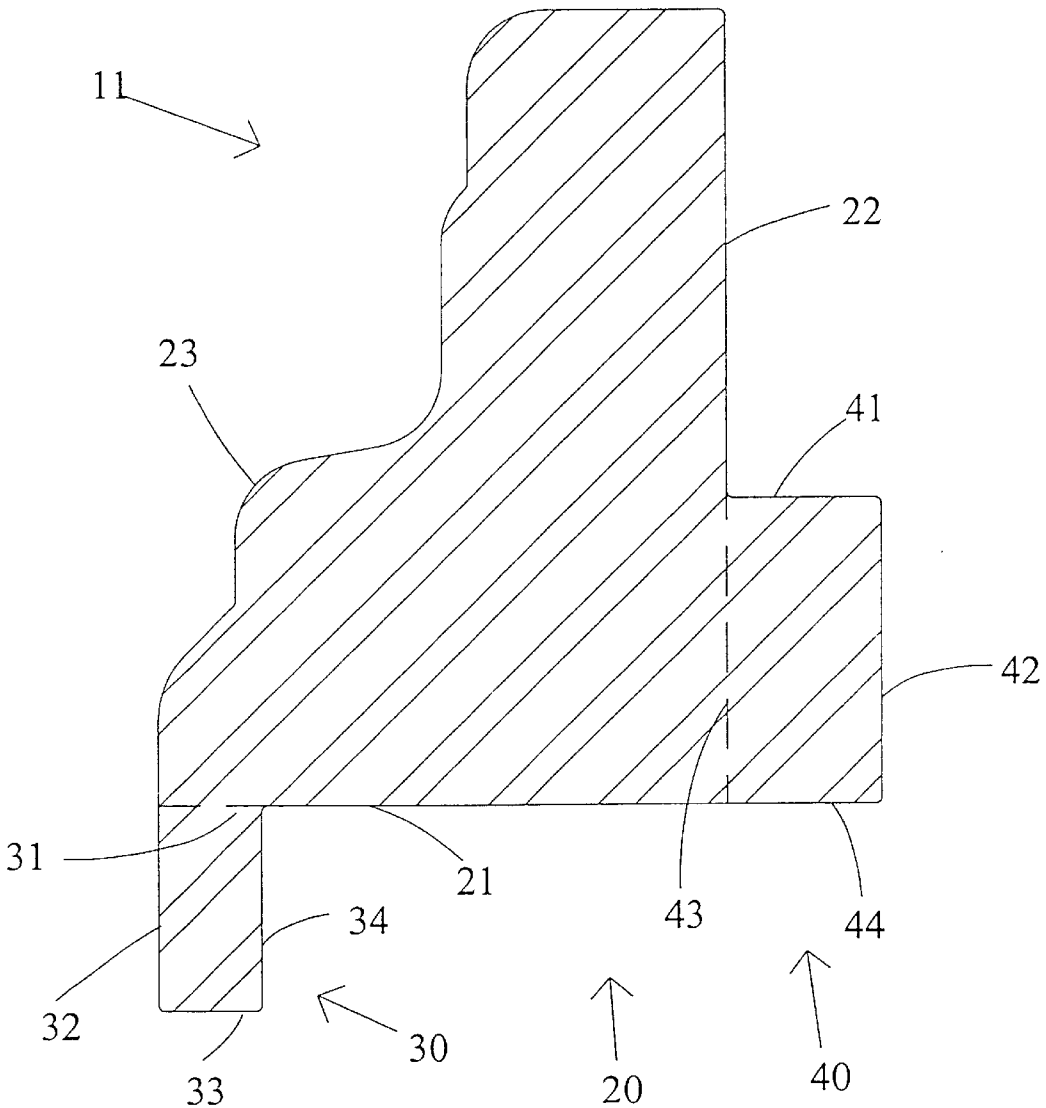
FIG. 1 is a sectional view of the outside mount glass door mount.

In its preferred embodiment, the outside mount glass door mount framing piece (11) is an essentially T shaped, elongated member composed of extruded polyvinyl foam. As illustrated in FIG. 1, there are three integrally connected portions of framing piece (11). The first portion is a mounting portion (20) which is placed against the window panel of the door so that it overlaps the glass mounting bead. The second portion is a bead covering portion (30) which is integrally connected to mounting portion (20) and extends from mounting portion (20) to cover the glass mounting bead. The third portion is a light stop portion (40) which is integrally connected to mounting portion (20) and extends from mounting portion (20) to block light passing between framing piece (11) and the shutter panel.

Mounting portion (20) has essentially three sides including a rear mounting surface (21), a shutter mounting surface (22), and a front mounting surface (23). Rear mounting surface (21) is an essentially planar surface positioned parallel to the door. Shutter mounting surface (22) is an essentially planar surface, normal and proximate to rear mounting surface (21). Shutter panels will be attached to shutter mounting surface (22) in an abutting relationship with hinges and the hinged mount will create a vertical margin through which light may pass. Front mounting surface (23) is the remaining surface of the essentially L shaped mounting portion (22). Front mounting surface (23) is made up of a series of interconnected curvilinear shapes which provide an aesthetic facade for framing piece (11).

Light-stop portion (40) has a least two exterior surfaces and one interior surface. The interior light-stop surface (43) is integrally connected to shutter mounting surface (22) proximate to the rear mounting surface (21). The light-stop surface (41) is normal to shutter mounting surface (22) and positioned a predetermined distance from the front edge of shutter mounting surface (22). The visible surface (42) extends proximate to the light-stop surface (41) and essentially parallel to the shutter mounting surface (22). In its various embodiments visible surface (42) can be any shape or configuration extending between light-stop surface (41) and rear mounting surface (21). In the preferred embodiment visible surface (42) is generally planar and parallel to the shutter mounting surface and a rear light-stop surface (44) extends between rear mounting surface (21) and visible surface (42). Light-stop surface (41) will be partially visible at all times between the shutter mounting surface and the hingedly attached shutter panels. Light-stop surface (41) blocks light that would otherwise pass through the vertical margin between the hingedly connected shutter mounting frame (22) and shutter panels.

Bead covering portion (30) is integrally connected to mounting portion (20) proximate to front mounting surface (23). Bead covering portion (30) extends normal to the rear mounting surface (21) proximate to front mounting surface (23). Bead covering portion (30) has three exterior surfaces and one interior surface. The interior bead cover surface (31)

is integrally connected to rear mounting surface (21) proximate to front mounting surface (23). The visible bead cover surface (32) appears as an continuation of the front mounting surface (23) and is positioned essentially normal to the door. The rear bead cover surface (33) is parallel to rear mounting surface (21) and contacts the door adjacent to the glass mounting bead. The hidden bead cover surface (34) is normal to rear mounting surface (21) and the rear bead cover surface (33). Bead covering portion (30) forms an extension on the framing piece (11) that covers the glass mounting bead and positions mounting portion (20) so that the mounting devices pass through front mounting surface (23), rear mounting surface (21) and into the glass mounting bead in order to secure framing piece (11) to the door with glass inserts.

Figure 2:
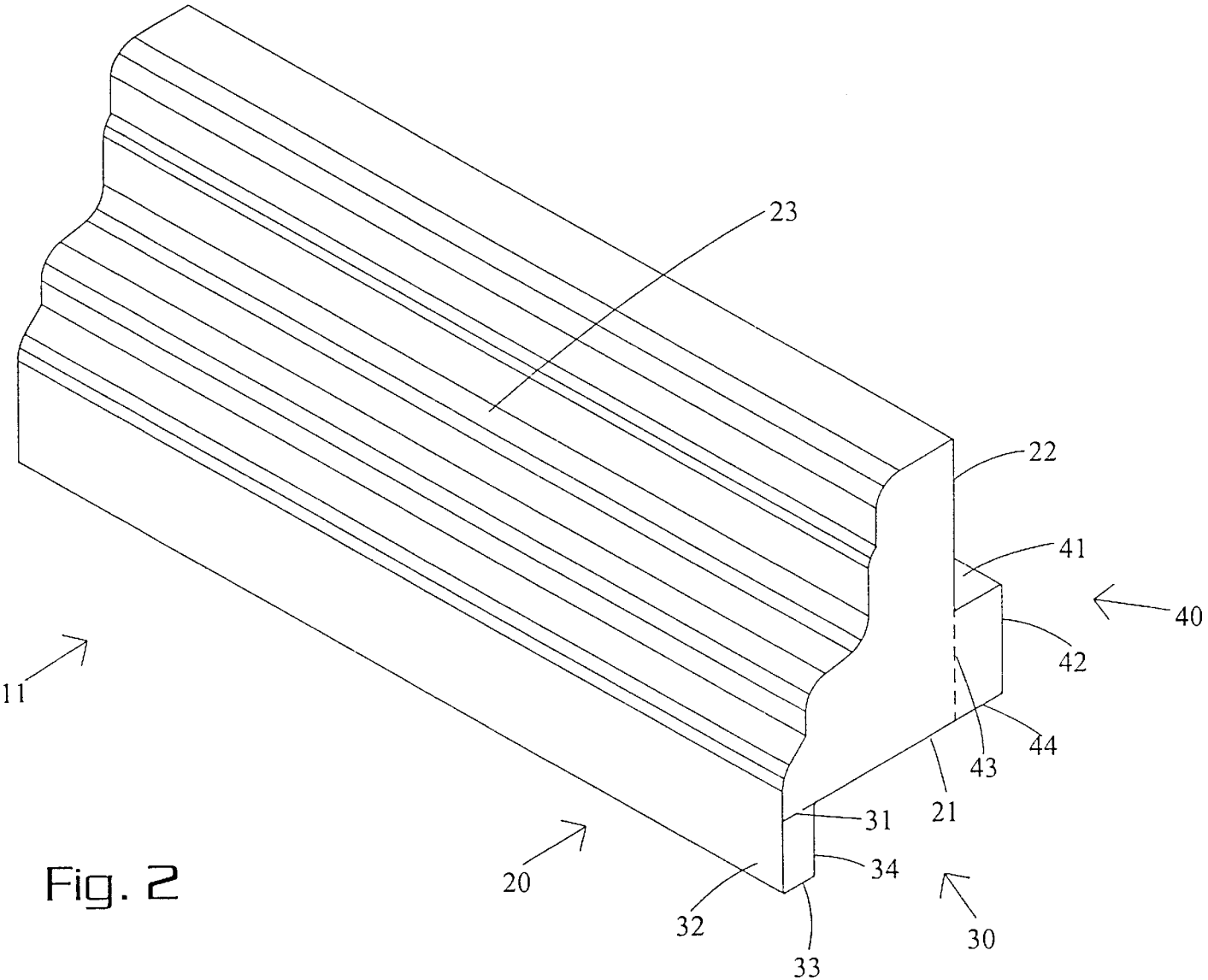
FIG. 2 is a perspective view of the outside mount glass door mount.

FIG. 2 illustrates framing piece (11) in a dimensional view. The first portion of framing piece (11) is mounting portion (20) which includes rear mounting surface (21) and shutter mounting surface (22) and front mounting surface (23). The second portion is light-stop portion (40) including light-stop surface (41), rear light-stop surface (44), visible surface (42), and interior light stop surface (43). Light-stop portion (40) blocks the light passing through the vertical margin between the hingedly attached shutter mounting surface (22) and the shutter panel. The third portion is bead covering portion (30) which covers the glass mounting bead on the door with the glass insert. Bead covering portion (30) includes interior bead cover surface (31), visible bead cover surface (32), rear bead cover surface (33), and hidden bead cover surface (34).

Figure 3:
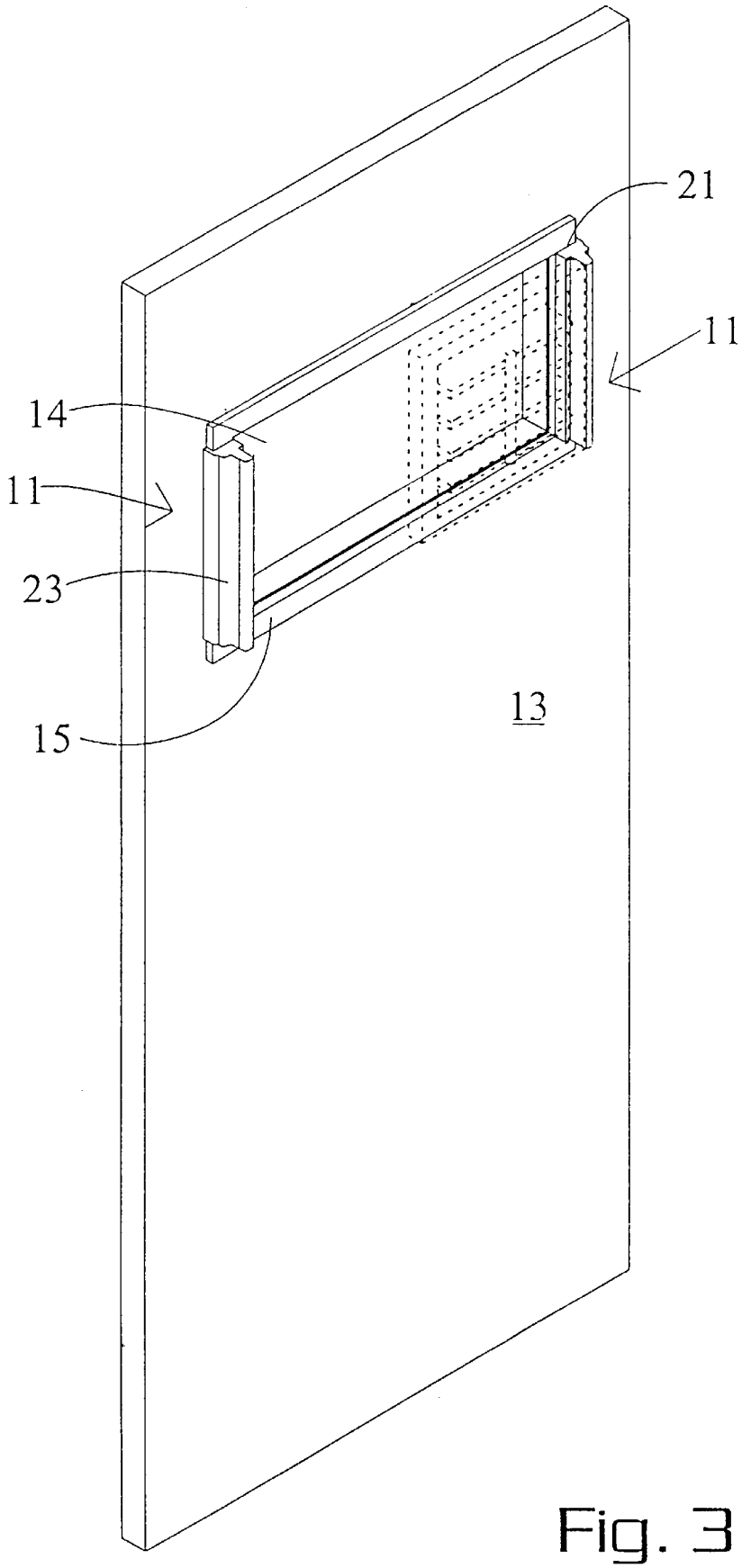
FIG. 3 is a perspective view of the outside mount glass door mount. in contact with an existing door and glass insert; and, FIG. 4 is a perspective sectional view of the outside mount glass door mount with optional pre-drilled mounting holes.

FIG. 3 shows a dimensional view of framing piece (11) in contact with a door (13) having a glass insert (14). The glass is secured in door (13) by a glass mounting bead (15) which surrounds the glass panel. Framing piece (11) is mounted on door (13) by screws, nails or other attachment means which pass through front mounting surface (23) and rear mounting surface (21), into glass mounting bead (15).

Figure 4:
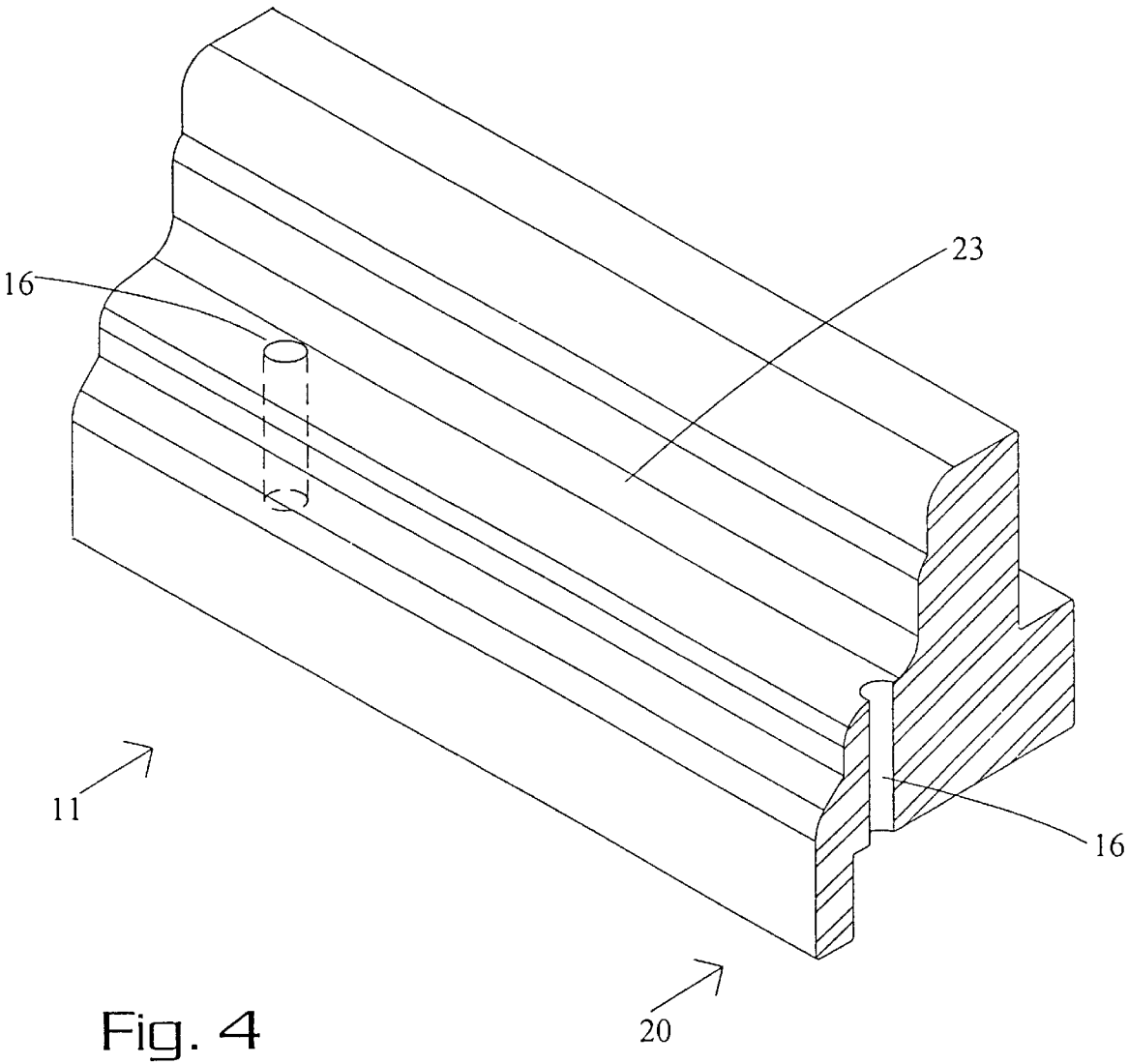

FIG. 4 is a dimensional cross-section view of framing piece (11) which illustrates optional pre-drilled mounting holes (16) in mounting portion (20). Pre-drilled mounting holes (16) are a convenience, but are not necessary for installation. Unlike wood, the extruded polyvinyl foam will not split when nails or screws are inserted for mounting purposes. In the preferred embodiment, the frame is mounted with nails inserted by an impulse nail gun.

While this invention has been described in connection with particular examples thereof, it is to be understood that other modifications will become apparent to the skilled practitioner upon a study of the drawings, specification and following claims, and such changes or modifications may be made without departing from the spirit of the invention or scope as defined in the following claims.

What I claim is:

1. An elongated essentially T shaped member for mounting and framing shutters on a door with glass inserts, said elongated T shaped member comprising:

a mounting portion;

a bead covering portion; and a light-stop portion;

said mounting portion having a rear mounting surface substantially parallel to said door, a shutter mounting surface normal to said rear mounting surface, and a front mounting surface substantially parallel to said rear surface;

said bead covering portion integrally connected to said mounting portion and extending normal to said rear mounting surface;

said light-stop portion integral with the mounting portion, having a light-stop surface normal to said shutter mounting surface and extending a predetermined distance from said shutter mounting surface.

2. The T shaped member of claim 1 wherein said T shaped member is extruded polyvinyl foam.

3. The T shaped member of claim 1 wherein said light-stop portion comprises a rear light-stop surface parallel and proximate said rear mounting surface, a visible surface normal and proximate said rear light-stop surface and said light-stop surface normal to said rear mounting surface and proximate said visible surface.

4. The T shaped member of claim 3 wherein said rear light-stop surface and rear mounting surface are co-planar.

5. The T shaped member of claim 1 wherein said bead covering portion is essentially rectangular.

6. The T shaped member of claim 1 wherein said front mounting surface comprises a series of interconnected curvilinear shapes providing an aesthetic facade for said T shaped member.

7. The T shaped member of claim 1 in combination with a shutter panel having a vertical margin said shutter panel hingedly mounted to said T shaped member in abutting relationship to said shutter mounting surface in a closed position such that said light-stop surface extends horizontally beyond said vertical margin to block light passing between said shutter panel and said shutter mounting surface.

8. The T shaped member of claim 1 wherein said T shaped member is attached to said door by attachment means placed through said mounting portion.

9. The T shaped member of claim 8 wherein said attachment means are nails.

10. The T shaped member of claim 8 wherein said attachment means are screws.

11. The T shaped member of claim 1 wherein said mounting portion contains pre-drilled holes for mounting said T shaped member to said door.

12. The T shaped member of claim 11 wherein said T shaped member is attached to said door by attachment means placed through said pre-drilled mounting holes in said mounting portion.

13. The T shaped member of claim 12 wherein said attachment means are nails.

14. The T shaped member of claim 12 wherein said attachment means are screws.

15. A shutter framing piece of a door shutter system in combination with a door, a glass insert in said door, and a glass mounting bead, said shutter framing piece comprising:

a mounting portion;

a bead covering portion; and a light-stop portion;

said mounting portion further comprising:

a rear mounting surface substantially parallel to a width of said door, a shutter mounting surface normal to said rear mounting surface, and a front mounting surface substantially parallel to said rear surface;

said bead covering portion integrally connected to said mounting portion and extending normal to said rear mounting surface and proximate to said front mounting surface;

said light-stop portion integrally connected to the mounting portion and further comprising a light-stop surface normal to said shutter mounting surface and positioned a predetermined distance said shutter mounting surface.

16. The shutter framing piece of claim 15 wherein said shutter framing piece is extruded polyvinyl foam.

17. The shutter framing piece of claim 15 in combination with a shutter panel having a vertical margin, said shutter panel hingedly mounted to said shutter framing piece in abutting relationship to said shutter mounting surface in a closed position such that said light-stop surface extends horizontally beyond said vertical margin to block light passing between said shutter panel and said shutter mounting surface.

18. The shutter framing piece of claim 15 wherein said light-stop portion further comprises:

a rear light-stop surface parallel and proximate said rear mounting surface, and a visible surface normal and proximate said rear light-stop surface;

said light-stop surface normal to said rear mounting surface and proximate said visible surface.

19. The shutter framing piece of claim 18 wherein said rear light-stop surface and rear mounting surface are co-planar.

20. The shutter framing piece of claim 15 wherein said bead covering portion is essentially rectangular shaped.

21. The shutter framing piece of claim 15 wherein said front mounting surface comprises a series of interconnected curvilinear shapes providing an aesthetic facade for said shutter framing piece.

22. The shutter framing piece of claim 15 in combination with a shutter panel having a vertical margin, said shutter panel hingedly mounted to said channel member in abutting relationship to said shutter mounting surface in a closed position such that said light-stop surface extends horizontally beyond said vertical margin to block light passing between said shutter panel and said shutter mounting surface.

23. The shutter framing piece of claim 15 wherein said shutter framing member is attached to said door by attachment means placed through said mounting portion.

24. The shutter framing piece of claim 23 wherein said attachment means are nails.

25. The shutter framing piece of claim 23 wherein said attachment means are screws.

26. The shutter framing piece of claim 15 wherein said mounting portion contains pre-drilled holes for mounting said shutter framing piece to said door.

27. The shutter framing piece of claim 26 wherein said shutter framing piece is attached to said door by attachment means placed through said pre-drilled mounting holes in said mounting portion.

28. The shutter framing piece of claim 27 wherein said attachment means are nails.

29. The shutter framing piece of claim 27 wherein said attachment means are screws.

* * * * *